United States Patent [19]

Richman

[11] 4,096,848

[45] Jun. 27, 1978

[54] FIREPLACE ASH SYSTEM FOR BASEMENTLESS BUILDINGS

[76] Inventor: William M. Richman, Hill-Top Heights, North Platte, Nebr. 69101

[21] Appl. No.: 521,167

[22] Filed: Nov. 5, 1974

Related U.S. Application Data

[63] Continuation-in-part of Ser. No. 331,666, Feb. 12, 1973, abandoned.

[51] Int. Cl.[2] ..... F24B 1/18

[52] U.S. Cl. ..... 126/120; 126/242

[58] Field of Search ..... 126/120, 121, 242

[56] References Cited

U.S. PATENT DOCUMENTS

| | | | |
|---|---|---|---|
| 1,786,453 | 12/1930 | Risdon | 126/120 |
| 2,444,985 | 7/1948 | Fulton | 126/242 |

*Primary Examiner*—Ronald C. Capossela

[57] ABSTRACT

A basementless house having a fireplace ash removal system partially disposed beneath the fireplace and having an auger extending under a floor to an ash removal pit at a side of a house, a hopper beneath the fireplace having doors for servicing a motor and a power transfer assembly.

8 Claims, 4 Drawing Figures

FIREPLACE ASH SYSTEM FOR BASEMENTLESS BUILDINGS

This application is a continuation-in-part of the applicant's co-pending patent application Ser. No. 331,666, filed Feb. 12, 1973, and titled: FIREPLACE WITH UNDERFLOOR ASH REMOVAL SYSTEM now abandoned, which latter was co-pending with the applicant's earlier patent application Ser. No. 74,705, filed Jan. 29, 1971, titled FIREPLACES, by William Marshall Richman now abandoned.

FIELD OF THE INVENTION

This invention is in the field of houses and building having a floor slab laid on-the-ground construction or having only a crawl space, in either case, having no full-sized basement for convenient removal of ash from beneath the first floor fireplace in the usual gravity fall manner.

DESCRIPTION OF THE PRIOR ART

In a basementless house there is no possibility of having a gravity fall chute simply carrying ashes from the fireplace to a basement area where the dirty ashes are less dangerous to furniture.

Scooping the ashes out of a fireplace in the living room soils valuable furniture and carpeting because the lighter ash particles float freely and cover furniture with soot.

Where there is no place to allow the ashes to fall down below the fireplace, it is often necessary to remove the ashes from the fireplace and dispose of them out-of-doors on a cold day when that is not as desirable.

If a fireplace is on an outer wall and its backside is above ground, it is possible to have a hole therethrough for ash to fall so that ash can be pushed through such a hole. But, such a construction has a great disadvantage because such an opening is hard to seal and wind blowing from the outside can enter blowing ashes up into the living areas of the house.

It is desirable that a fireplace be able to receive air up through an opening in its underside to provide desirable draft and, particularly this is true, when the front of the fireplace is covered with glass doors instead of a screen. It is desirable that air be able to enter from the bottom of a fireplace, which is around cracks in a one-way valve system such as is common to reach the fire from that direction, but this is only practical where the area beneath the fireplace floor hole is sufficiently able to get air without wind being able to whip into it and create such a draft that ash will be blown out of the fireplace into living areas.

The possibility of outside air entering up through the bottom of a fireplace prevents oxygen from being burned out of the inside of the house whereby the house is more livable and a fireplace is more desirable to use.

When houses are made with fireplaces spaced from the outside walls and a floor slab made by casting the floor directly on the ground, there is no access area in which a person can enter to clean ashes out of a chute beneath the fireplace, as is the common way in houses having full basements. As a consequence, builders have been completely baffled, in my experience, and are all leaving the home owner with the problem of carrying the ashes from the fireplace through the living room areas of the house in order to dispose of them outdoors.

This has had the double disadvantage of the soiling of the living room with light ash that flies in the air and also the disadvantage that there is no storage place beneath the fireplace in which a reservoir of ashes can accumulate to make it unnecessary for the owner of the house to empty ashes so frequently as to be a constant nuisance.

I have also had the experience of seeing an expensive house built with a crawl-space area beneath the floor, an expensive fireplace of fine rocks put in the house, and yet the only way to clean ashes from beneath the fireplace would require a person to crawl across the surface of the ground beneath the floor of that house to handle ashes.

It appears to me that the problems involved in mere crawl-space houses or slab-on-the-ground houses of how to dispose of fireplace ash conveniently has been baffling to the prior art.

The conventional ways hold no answer, and it is an object of this invention to provide an answer to this problem.

SUMMARY OF THE INVENTION

In combination: a building, the building being free of any basement means making it possible for a human being to enter a space surrounding a hopper beneath the fireplace from the outside of the building or from above, an auger conveyor assembly leading from the hopper through a major load-bearing wall of the building for delivering ash to a point on the other side of the hopper from the wall, such as to a point on the outer side of the building, an ash-receiving chamber disposed at said point and receiving ash from the conveyor assembly.

The fireplace ash removal system described in which access door means are provided in said hopper for reaching and servicing a motor operating in said conveyor, and for reaching and servicing a belt and pulley system. The motor being removable from the hopper and upwardly through the upper side of the hopper for servicing.

A further object is to provide the combination described in which the building particularly has a concrete slab floor formed by spreading the concrete material across an area of the surface of the earth, whereby the earth supports the floor slab, the floor slab being adjacent to the fireplace.

The fireplace ash system of this invention has a fireplace spaced all outside load-bearing walls by substantial distances, whereby because it has a floor slab, or in other words, is basementless without a basement an average man can stand up in, the building is one in which convenient removal of ashes from an area beneath the slab floor is impossible and the necessity of an auger is great because there is no possibility of using a gravity-fall chute.

Another object is to provide a system as described in which an ash-receiving pit and the conveyor housing leading to the ash-receiving pit together form a pit and conveyor housing assembly, the latter assembly having a vent passage means thereinto for allowing fresh air from the out-of-doors to travel up through the hopper to feed the fire in the fireplace, the vent passage means being protected from falling rain by a cover.

A further object is to provide an ash pit of the assembly with a housing or wall having a removable section removably attached to the remainder of the wall and disposed on that side thereof which is opposite from the conveyor housing whereby when the removable section of the pit wall is removed, the auger can be moved lengthwise from the conveyor housing for servicing or replacement.

A further object is to provide an assembly as described in which the upper end of the hopper has a grating so large that the majority of the ashes from the fireplace can fall down through the grating directly and without need for a person to push the ashes, as would be necessary if the grating were much smaller.

DESCRIPTION OF THE PREFERRED EMBODIMENT

Figure 1:
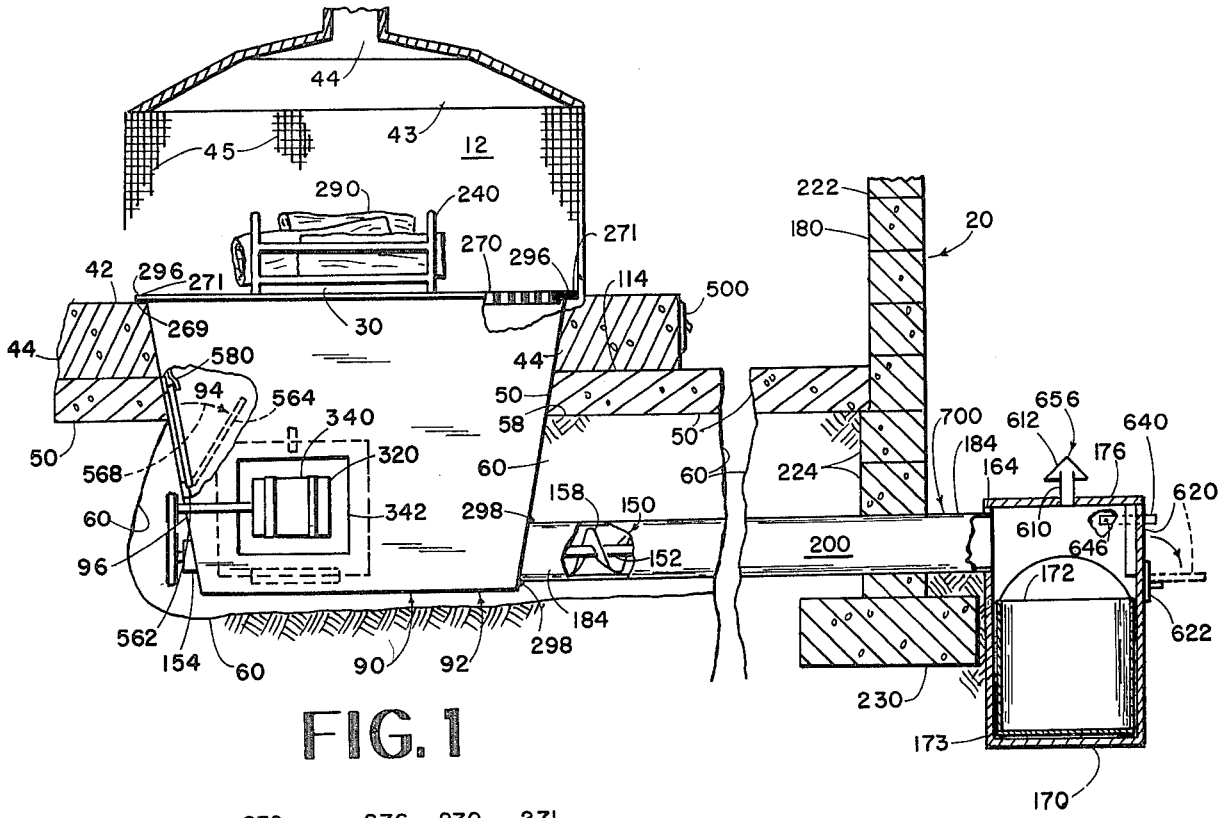
FIG. 1 is a view showing the ash removal system of this invention as seen from a forward side thereof but with parts broken away to show other parts, and parts thereof being shown in section, a forward side of an ash pit being broken away showing a bucket therein, those parts of the building and of the earth which surround the ash removal system of this invention are shown in FIG. 1 in section as though they were seen along a vertical plane extending in parallelism with the center of a chimney above a fireplace hood, only portions of a hood-mounted spark-screen being shown. A portion of an ash pit wall is broken away showing a removable wall section securing means.

Referring to FIG. 1 a building, fireplace, and fireplace ash removal system is generally shown in combination at 10 in which a fireplace is shown at 12 spaced a substantial distance from all outer walls of a building generally indicated at 20.

The fireplace has an opening 30 surrounding it and disposed above the upper surface 42 of the hearth 44 and beneath a hood 43 leading to chimney 44.

The hood has a retractable spark-screen 45 surrounding and closing the opening 30 at times, as is common to "out-in-the-room" fireplaces which are away from outer walls.

The hearth 42 is made of refractory material disposed above a concrete floor slab 50 of the building 20, the slab 50 in this illustration being one of the type which is cast across the surface 58 of the ground. The earth beneath the floor 50 is shown at 60.

An opening 70 extends downwardly through the refractory material 44 of the hearth through the floor slab 50 and into the earth 60, so as to receive parts of an ash removal system of this invention, generally indicated at 90, and particularly to receive a hopper 92 thereof which has a forward wall 94, sidewalls 96 and a rearward wall 98.

The hopper 92 has a curved bottom wall 132, closely engaging the cylindrical outline of an auger, best seen in FIG. 1 at 150, and having an axle 152 rotatable on a bearing 154. The flights or spiral part of the auger are shown at 158 and are to be understood as extending completely through the inner portion of the hopper 90 up through one side thereof and over to an opening 164 in a side wall of an ash receiving pit 170 so as to carry ashes from the hopper to the pit 170 and to cause them to be in a position to be easily removed from the pit 170 by means of a bucket 172, in the bottom of the well, at times when a lid 176 of the well is removed for that purpose. The pit 170 is disposed at a point which is on the outer side of the building 20 and specifically on that side of a load bearing outer wall 180 of the building 20 which is on the opposite side of the wall 180 from the hopper 90. The pit 170 can either be on the outer side of the house completely and out of doors or else it can be received in other means not shown if desired. An important feature of the invention is that the auger 150 and its housing 184, which latter two elements form a conveyor 200, extend completely through the load bearing wall 180, which latter is either an outer wall, or at least a major load bearing wall of the building 20, as illustrated by the fact that it is composed for illustration of cement blocks 222, rested on foundation blocks 224, which latter is rested upon a footing 230.

FIG. 1 has a portion broken away to illustrate that the distance between the fireplace and the wall 180 can be any distance.

In the fireplace 12 is a grate 240 for supporting a fire, the ashes of which are free to fall through a grating 270 in an upper portion 272 of the hopper 90, the grating having many openings 276 therethrough which are of the area of one and one-half inch squares each to prevent large unburned objects from falling down into the hopper but to permit ashes to freely fall into the hopper from the fire. The hopper is substantially covering the major portion of the underside of the fireplace grating 270 so that the major part of the ashes will fall directly into the hopper from the fire 290.

As best seen in FIG. 1, the hopper has horizontal flanges 296 on its upper side, and projecting horizontally therefrom to rest on the top of the hearth 44. This supports the hopper.

The conveyor 200 is suitably secured to the hopper for support such as by means of a flange and bolt assembly 298 attaching the outer housing 184 of the auger system to the hopper.

Figure 3:
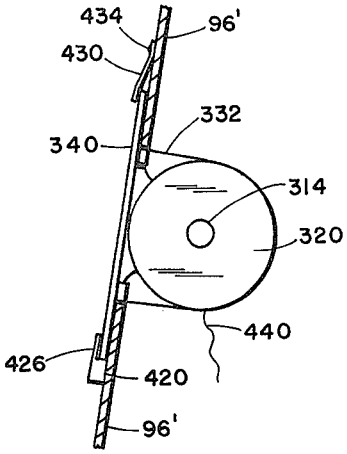
FIG. 3 is a sectional view of a portion of the hopper and motor as seen along a plane extending forwardly and rearwardly on the left-hand side of the main body of the motor in FIG. 1.

The auger axle 152 extends outwardly of that side of the hopper which is opposite the pit 170, and has thereon a pulley 310 connected by a drive belt 312 to a pulley 314 mounted on a drive motor 320, which latter is itself secured by straps 332 to a motor mounting panel 340 which is a flat plate disposed across and lapping all sides of a motor opening 342 in a forward side 96 of the hopper. The motor mounting plate 340, as seen in FIG. 3, is received against support blocks 420, which latter are affixed to the adjacent forward wall 96', the lower edge of the support plate 340 being held in place by pivoting or non-pivoting latch means, which overlaps the back side or inner side of the plate 340 to prevent it from slipping off of the ledge pieces or block pieces 420. The upper side of the motor mounting plate 340 is prevented from moving inwardly of the hopper by locking dogs 430, which pivot at 434, and are mounted on the forward wall 96' of the hopper so as to pivot out of the way to release the motor mounting plate for the removal of the motor upwardly through the inside of the hopper for servicing as is made possible by having a cord 440 on the motor, which is long enough to permit this to be done. The cord 440 can extend through a switch 500 shown in FIG. 1 in the wall 14, which latter is connected to house wiring for delivery of current to the motor 320 to operate it whenever the switch 500 is turned on. To service the motor it is necessary to disconnect the belt 312. For this purpose a belt access opening 560 is provided in a respective wall 96 of the hopper, which is opposite the pit 170 and the opening 560 is covered by a door 564 which laps all sides of the opening 560 on the inner side of the hopper, and is mounted on hinge means, seen in FIG. 1, at 562, permitting the door 564 to swing downwardly in the direction of a dotted arrow 568 in FIG. 1 for allowing access through the forward wall 96 for the removal or connection of the belt 312. The door 564 is held in place by locking dogs 580 pivoted and swinging on the inner side of the forward wall 96 above the door 564.

Figure 4:
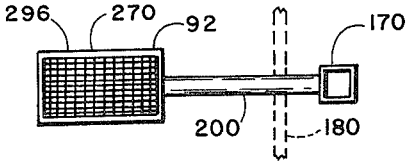
FIG. 4 is a diagrammatic view showing the grating and hopper as seen from the top, the auger housing, the ash pit, and showing the position of a major load-bearing wall of the building extending across the conveyor in dotted lines for convenience of illustration.

In FIG. 4, the grating 270 is shown in top plan view, and the flanges 296 of the hopper 92 can be seen with the conveyor 200 extending out through the wall 180, which latter is for convenience shown only in dotted lines in FIG. 4, with the pit 170 shown outside of the building.

In operation it will be seen that the operation of the switch 500 will permit the removal of the ashes with ease through the conveyor 100 to the pit where they can be removed from the outside of the house or building without soiling the furniture and with greater ease than shoveling the ashes out of the fireplace.

The grating 270 is removable from the hopper itself, since the grating has its own ledge 271 which overlaps the flanges 296 of the hopper for supporting the grating in a removable fashion.

The fireplace hearth or floor 41 and the building floor slab or floor 50 and the surface of the earth adjacent the outside of the building 20, all taken together, define at least a partial barrier to access to the places in which the motor 320 and drive train means (belt 312, pulleys 310 and 314) are disposed, such barrier having a service opening means 342, 560 through it.

The ground surface or earth surface 58 is disposed directly below and supporting the majority of the area of the building floor slab or floor 50, as is common to floor-slab-cast-on-the-ground buildings.

As best seen in FIG. 1, the upper surface of the earth at 600 which is disposed outside of the building 20 is disposed above the upper floor level 42 of the fireplace a substantial distance and earth outside of the house is indicated by the numeral 610 and substantially completely surrounds the receiving well 170.

There is no space beneath the floor 50 of the building which is sufficiently open for a man to stand in. In a sense, there is a zone between the underside of the floor and the earth beneath the floor which is less than four feet high, thereby defining a space which is insufficient for most men to stand up in.

In another sense, it can be expressed by saying that the building 20 is free of any basement means making it possible for a human being to enter the space surrounding the hopper from the outside of the building or from above the floor 50 of the building. The outside of the building and the area above the floor of the building define areas of easy human accessibility, and from such areas there is no access means making it possible for a human being to enter therefrom into the space surrounding the hopper. This same structure can be described in still another way by saying that the building 20 and the earth 60 together define a building and earth assembly 800 such that there is no passage of over four feet minimum height a human being can pass through from either one of said areas of easy human access so as to enter the space beneath the floor 50 and surrounding the hopper 90.

Figure 2:
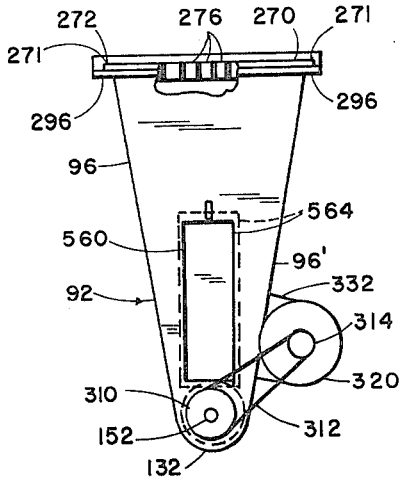
FIG. 2 is a perspective view of the hopper as seen from the left-hand side in FIG. 1 but also somewhat from the top thereof for showing the grating, the outlines of a door through the hopper for servicing a power drive assembly being shown in dotted lines.

Referring to FIG. 1 and FIG. 2, it can be seen that the auger has the innermost end of its shaft on the outerside of the hopper and that the belt 312 constitutes a removable portion of the drive means and the opening 560 and its door 564 cooperate therewith. The opening 560 provides a drive train access opening through the hopper when the door 564 is removed so that the removable drive train access section necessary is provided by the door 564 and covers the drive train access opening 560 to prevent ashes from falling through. As thus described, when the drive train access section of the hopper, which is represented by the door 564, is removed, a workman can reach through the opening 560 and remove the belt 312 so as to free the motor for removal and servicing in the manner above described.

In FIG. 1 it can be seen that the ash pit 170 has a wall assembly 173 which has an opening 174 therethrough opening to the auger housing 184.

The assembly 173 includes the hinged lid 176 which makes it possible to open the pit wall assembly 173 to remove the bucket 172.

Through the top of the lid 176 is a vent passage pipe 610 having a cover 612 attached thereto in a suitable fashion for preventing rainfall from falling directly vertically downward through the pipe 610 on which it is mounted to the interior of the pit wall assembly 173 and permits air to travel therethrough and through the conveyor housing 184 up through the hopper through the grate 270 and to the fire to provide oxygen from out-of-doors so the fire does not consume as much of the oxygen needed by human occupants of the house and so that the living area of the hous is less drafty.

The pit wall assembly 173 further has a removable section 620 hingedly attached to it by hinge 622 and adapted to be opened to go down to a horizontal position as seen in dotted lines in FIG. 1, in order to permit the auger to be removed horizontally therethrough for repair or replacement.

The removable section 620 is normally held in place by a bracket 640 bolted by bolt 646 to the pit wall assembly 173 whereby when the bolt 646 is removed and the bracket 640 removed, the removable wall section 620 can be moved downwardly into the dotted line position shown in FIG. 1.

The pit wall assembly 173 and the conveyor housing 184 can be together called a combination pit wall assembly and conveyor housing 700 to which latter a vent passage assembly 656, which latter is formed of the pipe 610 and its cover 612, permits air to pass from the out-of-doors.

Another way of expressing the basementless nature of the building is to say that the building 20 is free of any space or zone between the underside of the floor and the earth beneath the floor which is over four feet high, thereby defining a space or a zone which is insufficient for most men to stand up in or to walk through erect in order to reach and work on the space surrounding the hopper in order to work on the motor and drive train or to remove and replace parts thereof while a man over four feet tall is standing erect.

I claim:

1. A fireplace ash removal system, building, and fireplace assembly comprising: a building, said building having a foundation and having a major load-bearing outer wall above said foundation, earth disposed under and against the outer side of at least a substantial part of said building, a fireplace in said building having a hearth and provided with an open side through which fuel can be inserted thereinto, hopper means disposed beneath said fireplace and extending downwardly beyond said floor, said hopper means having opening means on its upper side in communication with the interior of said fireplace for receiving ash therethrough, said fireplace being disposed within the outer sides of said outer walls of said building, an auger conveyor assembly disposed in communication with said hopper for receiving ash therefrom, said conveyor assembly extending from said hopper to a point for delivering ash to said point, said point being on the other side of said major leadbearing outer wall of said building from said hopper, an ash-receiving means disposed at said point, said ash-receiving means having walls and having an ash chamber therein receiving ash from said conveyor assembly and having an ash removal opening through its walls, the region beneath said hearth and the region outside of said building in the vicinities of said ash-receiving means and of that portion of said conveyor assembly that is outside of said outer wall defining a pair of regions, said conveyor assembly comprising a housing leading from said hopper, and an auger in said housing, said conveyor housing being free of such an inclination with respect to the horizontal that ashes can fall freely therethrough by gravity alone, said conveyor assembly having a drive motor, drive train means drivably connecting said motor to said auger, said motor and drive train means being located in one of said regions, the area above said floor and to the side of said fireplace and the area above the ground outside of said building defining a pair of areas of easy human access, said building and earth defining a building and earth assembly, said building and earth assembly creating an obstruction so great as to leave no passage of over four feet minimum height a human being can pass through from either one of said areas of easy human access so as to enter the space beneath said floor and surrounding said hopper means, said fireplace having a fireplace floor, said fireplace floor and said building floor and said earth all together defining at least a partial barrier to access to the place in which said motor is disposed, said barrier having a service opening means through it providing access to said drive motor for servicing, said fireplace being substantially spaced from the outer walls of said building whereby said auger is important, said hopper having a motor access opening therethrough from an inner side thereof to an outer side thereof and serving as a portion of said service opening means.

2. The assembly of claim 1 in which said auger has a shaft portion on the outer side of said hopper, said drive means having a removable portion, said hopper having a drive train access opening therethrough, said hopper having a removable drive train access section therethrough covering said drive train access opening whereby when said drive train access section is removed a workman can reach said removable portion of said drive train means and remove it to free said motor for removal and servicing.

3. A fireplace ash removal system, building, and fireplace assembly comprising: a building, said building having a foundation and having a major load-bearing outer wall above said foundation, earth disposed under and against the outer side of at least a substantial part of said building, a fireplace in said building having a hearth and provided with an open side through which fuel can be inserted thereinto, hopper means disposed beneath said fireplace and extending downwardly beyond said floor, said hopper means having opening means on its upper side in communication with the interior of said fireplace for receiving ash therethrough, said fireplace being disposed within the outer sides of said outer walls of said building, an auger conveyor assembly disposed in communication with said hopper for receiving ash therefrom, said conveyor assembly extending from said hopper to a point for delivering ash to said point, said point being on the other side of said major lead-bearing outer wall of said building from said hopper, an ash-receiving means disposed at said point, said ash-receiving means having walls and having an ash chamber therein receiving ash from said conveyor assembly and having an ash removal opening through its walls, the region beneath said hearth and the region outside of said building in the vicinities of said ash-receiving means and of that portion of said conveyor assembly that is outside of said outer wall defining a pair of regions, said conveyor assembly comprising a housing leading from said hopper, and an auger in said housing, said conveyor housing being free of such an inclination with respect to the horizontal that ashes can fall freely therethrough by gravity alone, said conveyor assembly having a drive motor, drive train means drivably connecting said motor to said auger, said motor and drive train means being located in one of said regions, the area above said floor and to the side of said fireplace and the area above the ground outside of said building defining a pair of areas of easy human access, said building and earth defining a building and earth assembly, said building and earth assembly creating an obstruction so great as to leave no passage of over four feet minimum height a human being can pass through from either one of said areas of easy human access so as to enter the space beneath said floor and surrounding said hopper means, said fireplace having a fireplace floor, said fireplace floor and said building floor and said earth all together defining at least a partial barrier to access to the place in which said motor is disposed, said barrier having a service opening means through it providing access to said drive motor for servicing, said fireplace being substantially spaced from the outer walls of said building whereby said auger is important, said ash-receiving means being disposed in a pit in the earth outside of said outer wall, said pit and said conveyor housing forming a pit and conveyor housing assembly, said latter assembly having vent passage means thereinto and allowing air to travel to said hopper to feed fire in said fireplace, the upper end of said vent passage means having covering means thereon to prevent vertically falling rain from entering said vent passage means.

4. A fireplace ash removal system, building, and fireplace assembly comprising: a building, said building having a foundation and having a major load-bearing outer wall above said foundation, earth disposed under and against the outer side of at least a substantial part of said building, a fireplace in said building having a hearth and provided with an open side through which fuel can be inserted thereinto, hopper means disposed beneath said fireplace and extending downwardly beyond said floor, said hopper means having opening means on its upper side in communication with the interior of said fireplace for receiving ash therethrough, said fireplace being disposed within the outer sides of said outer walls of said building, an auger conveyor assembly disposed in communication with said hopper for receiving ash therefrom, said conveyor assembly extending from said hopper to a point for delivering ash to said point, said point being on the other side of said major leadbearing outer wall of said building from said hopper, an ash-receiving means disposed at said point, said ash-receiving means having walls and having an ash chamber therein receiving ash from said conveyor assembly and having an ash removal opening through its walls, the region beneath said hearth and the region outside of said building in the vicinities of said ash-receiving means and of that portion of said conveyor assembly that is outside of said outer wall defining a pair of regions, said conveyor assembly comprising a housing leading from said hopper, and an auger in said housing, said conveyor housing being free of such an inclination with respect to the horizontal that ashes can fall freely therethrough by gravity alone, said conveyor assembly having a drive motor, drive train means drivably connecting said motor to said auger, said motor and drive train means being located in one of said regions, the area above said floor and to the side of said fireplace and the area above the ground outside of said building defining a pair of areas of easy human access, said building and earth defining a building and earth assembly, said building and earth assembly creating an obstruction so great as to leave no passage of over four feet minimum height a human being can pass through from either one of said areas of easy human access so as to enter the space beneath said floor and surrounding said hopper means, said fireplace having a fireplace floor, said fireplace floor and said building floor and said earth all together defining at least a partial barrier to access to the place in which said motor is disposed, said barrier having a service opening means through it providing access to said drive motor for servicing, said fireplace being substantially spaced from the outer walls of said building whereby said auger is important, said ash-receiving means being disposed in a pit in the earth outside of said outer wall, said pit having a pit-wall, said pit-wall having a removable section removably attached to the remainder thereof and disposed on the side thereof opposite from said conveyor housing whereby said removable pit-wall section can be removed so as to permit said auger to be removed lengthwise from said conveyor housing.

5. A fireplace ash removal system, building, and fireplace assembly comprising: a building, said building having a foundation and having a major load-bearing outer wall above said foundation, earth disposed under and against the outer side of at least a substantial par' of said building, a fireplace in said building having a hearth and provided with an open side through which fuel can be inserted thereinto, hopper means disposed beneath said fireplace and extending downwardly beyond said floor, said hopper means having opening means on its upper side in communication with the interior of said fireplace for receiving ash therethrough, said fireplace being disposed within the outer sides of said outer walls of said building, an auger conveyor assembly disposed in communication with said hopper for receiving ash therefrom, said conveyor assembly extending from said hopper to a point for delivering ash to said point, said point being on the other side of said major lead-bearing outer wall of said building from said hopper, an ash-receiving means disposed at said point, said ash-receiving means having walls and having an ash chamber therein receiving ash from said conveyor assembly and having an ash removal opening through its walls, the region beneath said hearth and the region outside of said building in the vicinities of said ash-receiving means and of that portion of said conveyor assembly that is outside of said outer wall defining a pair of regions, said conveyor assembly comprising a housing leading from said hopper, and an auger in said housing, said conveyor housing being free of such an inclination with respect to the horizontal that ashes can fall freely therethrough by gravity alone, said conveyor assembly having a drive motor, drive train means drivably connecting said motor to said auger, said motor and drive train means being located in one of said regions, the area above said floor and to the side of said fireplace and the area above the ground outside of said building defining a pair of areas of easy human access, said building and earth defining a building and earth assembly, said building and earth assembly creating an obstruction so great as to leave no passage of over four feet minimum height a human being can pass through from either one of said areas of easy human access so as to enter the space beneath said floor and surrounding said hopper means, said fireplace having a fireplace floor, said fireplace floor and said building floor and said earth all together defining at least a partial barrier to access to the place in which said motor is disposed, said barrier having a service opening means through it providing access to said drive motor for servicing, said fireplace being substantially spaced from the outer walls of said building whereby said auger is important, said motor being mounted on said hopper, said hopper having a motor access opening therethrough from an inner side thereof to an outer side thereof and serving as a portion of said service opening means, said hopper having a removable motor support section attached thereto by releasable means, and said motor being mounted on the outer side of said removable support section of said hopper, said removable support section covering said motor access opening, said motor access opening being large enough for the removal of said motor support section therethrough so it can be transported above said grating for servicing.

6. The assembly of claim 5 in which said auger has a shaft portion on the outer side of said hopper, said drive means having a removable portion, said hopper having a drive train access opening therethrough, said hopper having a removable drive train access section therethrough covering said drive train access opening whereby when said drive train access section is removed a workman can reach said removable portion of said drive train means and remove it to free said motor for removal and servicing.

7. A fireplace ash removal system, building, and fireplace assembly comprising: a building, said building having a foundation and having a major load-bearing outer wall above said foundation, earth disposed under and against the outer side of said least a substantial part of said building, a fireplace in said building having a hearth and provided with an open side through which fuel can be inserted thereinto, hopper means disposed beneath said fireplace and extending downwardly beyond said floor, said hopper means having opening means on its upper side in communication with the interior of said fireplace for receiving ash therethrough, said fireplace being disposed within the outer sides of said outer walls of said building, an auger conveyor assembly disposed in communication with said hopper for receiving ash therefrom, said conveyor assembly extending from said hopper to a point for delivering ash to said point, said point being on the other side of said major leadbearing outer wall of said building from said hopper, an ash-receiving means disposed at said point, said ash-receiving means having walls and having an ash chamber therein receiving ash from said conveyor assembly and having an ash removal opening through its walls, the region beneath said hearth and the region outside of said building in the vicinities of said ash-receiving means and of that portion of said conveyor assembly that is outside of said outer wall defining a pair of regions, said conveyor assembly comprising a housing leading from said hopper, and an auger in said housing, said conveyor housing being free of such an inclination with respect to the horizontal that ashes can fall freely therethrough by gravity alone, said conveyor assembly having a drive motor, drive train means drivably connecting said motor to said auger, said motor and drive train means being located in one of said regions, the area above said floor and to the side of said fireplace and the area above the ground outside of said building defining a pair of areas of easy human access, said building and earth defining a building and earth assembly, said building and earth assembly creating an obstruction so great as to leave no passage of over four feet minimum height a human being can pass through from either one of said areas of easy human access so as to enter the space beneath said floor and surrounding said hopper means, said fireplace having a fireplace floor, said fireplace floor and said building floor and said earth all together defining at least a partial barrier to access to the place in which said motor is disposed, said barrier having a service opening means through it providing access to said drive motor for servicing, said fireplace being substantially spaced from the outer walls of said building whereby said auger is important, said motor being mounted on an outer side of the said hopper, the wall of said hopper which is adjacent said motor inclining with respect to the vertical toward a vertical plane disposed at a forward side of said fireplace as the lower end of said hopper is approached from the upper end of said hopper, most of said motor being received in a space disposed vertically beneath the uppermost portions of said hopper and in which it is received, said hopper having a motor access opening therethrough from an inner side thereof to an outer side thereof and serving as a portion of said service opening means.

8. A fireplace ash removal system, building, and fireplace assembly comprising: a building, said building having a foundation and having a major load-bearing outer wall above said foundation, earth disposed under and against the outer side of at least a substantial part of said building, a fireplace in said building having a hearth and provided with an open side through which fuel can be inserted thereinto, hopper means disposed beneath said fireplace and extending downwardly beyond said floor, said hopper means having opening means on its upper side in communication with the interior of said fireplace for receiving ash therethrough, said fireplace being disposed within the outer sides of said outer walls of said building, an auger conveyor assembly disposed in communication with said hopper for receiving ash therefrom, said conveyor assembly extending from said hopper to a point for delivering ash to said point, said point being on the other side of said major leadbearing outer wall of said building from said hopper, an ash-receiving means disposed at said point, said ash-receiving means having walls and having an ash chamber therein receiving ash from said conveyor assembly and having an ash removal opening through its walls, the region beneath said hearth and the region outside of said building in the vicinities of said ash-receiving means and of that portion of said conveyor assembly that is outside of said outer wall defining a pair of regions, said conveyor assembly comprising a housing leading from said hopper, and an auger in said housing, said conveyor housing being free of such an inclination with respect to the horizontal that ashes can fall freely therethrough by gravity alone, said conveyor assembly having a drive motor, drive train means drivably connecting said motor to said auger, said motor and drive train means being located in one of said regions, the area above said floor and to the side of said fireplace and the area above the ground outside of said building defining a pair of areas of easy human access, said building and earth defining a building and earth assembly, said building and earth assembly creating an obstruction so great as to leave no passage of over four feet minimum height a human being can pass through from either one of said areas of easy human access so as to enter the space beneath said floor and surrounding said hopper means, said fireplace having a fireplace floor, said fireplace floor and said building floor and said earth all together defining at least a partial barrier to access to the place in which said motor is disposed, said barrier having a service opening means through it providing access to said drive motor for servicing, said fireplace being substantially spaced from the outer walls of said building whereby said auger is important, said hopper having a grating opening through its upper side and forming a part of said service access opening means, a grating across said grating opening and removably supported by said hopper, said grating permitting ashes to fall therethrough.

* * * * *